US005476747A

United States Patent [19]

Yoshida et al.

[11] Patent Number: 5,476,747

[45] Date of Patent: Dec. 19, 1995

[54] SILVER HALIDE LIGHT-SENSITIVE PHOTOGRAPHIC MATERIAL

[75] Inventors: Kazuhiro Yoshida; Takeshi Sampei; Toshiyuki Takabayashi, all of Hino, Japan

[73] Assignee: Konica Corporation, Japan

[21] Appl. No.: 367,015

[22] Filed: Dec. 29, 1994

[30] Foreign Application Priority Data

Jan. 13, 1994 [JP] Japan ..... 6-002176
Feb. 2, 1994 [JP] Japan ..... 6-011149

[51] Int. Cl.[6] ..... G03C 1/06

[52] U.S. Cl. ..... 430/264; 430/598; 430/531; 430/628; 430/642; 430/949; 430/599; 430/609

[58] Field of Search ..... 430/264, 598, 430/531, 628, 642, 949, 599, 609

[56] References Cited

U.S. PATENT DOCUMENTS

| | | | |
|---|---|---|---|
| 4,849,319 | 7/1989 | Inoue et al. | 430/264 |
| 4,975,354 | 12/1990 | Machonkin et al. | 430/264 |
| 5,004,669 | 4/1991 | Yamada et al. | 430/264 |
| 5,175,073 | 12/1992 | Gingello et al. | 430/264 |
| 5,210,002 | 5/1993 | Adin | 430/264 |
| 5,238,801 | 8/1993 | Iskigaki et al. | 430/264 |
| 5,284,733 | 2/1994 | Kojima et al. | 430/265 |
| 5,316,889 | 5/1994 | Sakai | 430/264 |
| 5,352,563 | 10/1994 | Kawasaki et al. | 430/264 |
| 5,374,498 | 12/1994 | Fujita et al. | 430/264 |

FOREIGN PATENT DOCUMENTS 0106542 4/1992 Japan .

*Primary Examiner*—Thomas R. Neville
*Attorney, Agent, or Firm*—Jordan B. Bierman; Bierman and Muserlian

[57] ABSTRACT

A silver halide photographic light-sensitive material comprises a support and provided thereon, a photographic component layer comprising a silver halide emulsion layer and a hydrophilic colloid layer other than the emulsion layer, wherein the photographic component layer contains a hydrazine derivative, a nucleation accelerating agent and polymer latex containing as a protective colloid a hydrophilic polymer having an average number molecular weight of 1,000 to 1,000,000 and having a solubility of not less than 0.1 g in 100 g of water at 20° C., provided that the hydrophilic polymer is not gelatin.

11 Claims, No Drawings

SILVER HALIDE LIGHT-SENSITIVE PHOTOGRAPHIC MATERIAL

FIELD OF THE INVENTION

The present invention relates to a silver halide light-sensitive photographic material. To be more specific, the present invention relates toga silver halide light-sensitive photographic material giving high contrast images, having improved preservation property and free from black spots.

BACKGROUND OF THE INVENTION

In recent years, color printing or complex printing has rapidly increased in photochemical printing processes. Therefore, demand for the improvement and stability of the quality of the silver halide photographic light-sensitive material, which is an intermediate medium for printing (hereinafter referred to a printing light-sensitive material) increases year by year.

Heretofore, to achieve high quality of a general light-sensitive material for printing, it is adapted with so-called "lith development". However, in "lith development" it is mechanically impossible to comprise in a developer solution a preservative, a sulfite in a high concentration and therefore, it is well known in the art that the stability of such developer is very poor.

As a technique to overcome the instability of lith development and obtain a high contrast image as obtained in lith development, a method using a hydrazine compound is disclosed in Japanese Patent O.P.I. Publication Nos. 53-16623 (1978) , 53-20921 (1978) , 53-20922 (1978) , 53-49429 (1978) , 53-66731 (1978), 53-66732 (1978), 53-77616 (1978), 53-84714 (1978), 53-137133 (1978), 54-37732 (1979), 54-40629 (1979), 55-52050 (1980) , 55-90940 (1980) , 56-67843 (1981) and 6-106244 (1981). To obtain a high contrast image in the processing method using these hydrazine compounds, pH of the developing solution containing the compounds or the pH of the developing solution of the photographic light-sensitive material comprising the compounds had to be relatively high. As a result, there was a problem that the effective lifetime of the developing solution tended to be shortened.

To overcome this problem, Japanese Patent O.P.I. Publication Nos.63-29751 (1988), 1-179939 (1989) and 1-179940 (1989) and U.S. Pat. No. 4,975,354 disclose a silver halide light-sensitive photographic material which comprises a hydrazine derivative and a nucleation accelerating agent, by which a high contrast photographic image can be obtained with a developing solution of relatively low pH. With the use of the contrast increasing agents, however, there was still a tendency that a lot of black spots, which are minute fog, occur. As means for decreasing the black spots, a technique of incorporating an acid polymer latex in silver halide light-sensitive photographic material is disclosed in Japanese Patent O.P.I. Publications Nos. 61-228437 (1986) and 4-106542 (1992), however, in order to obtain a high contrast image by this method using a developer of relatively low pH, it was necessary that an amino compound be added to the developing solution as a development accelerating agent. The amino compound added to the developer often has an extremely unpleasant smell. Moreover, it has an additional defect that the developing ability of the developing solution easily fluctuates due to its volatile nature. Furthermore, in order to stabilize dispersion of the latex in water, it is necessary to add a specific surfactant, however, this method limits the kinds of emulsions used and there has not yet been found a surfactant that does not give adverse influence on fog, sensitivity and development properties.

SUMMARY OF THE INVENTION

Therefore, an object of the present invention is to provide a silver halide light-sensitive photographic material having no adverse effects on photographic properties and its manufacture using latex, giving a high contrast image without generating black spots, even when it is processed with a low pH developing solution free of an amino compound, and produce a photographic images without black spots and sensitivity fluctuation even when it is processed with a fatigued developing solution.

DETAILED DESCRIPTION OF THE INVENTION

The above-mentioned object of the present invention has been attained by a silver halide light-sensitive photographic material comprising in combination, a hydrazine derivative, a nucleation accelerating agent and a latex having a hydrophilic polymer as a protective colloid, the latex obtained by polymerizing a polymerizable unsaturated compound in the presence of a hydrophilic polymer, and the hydrophilic polymer having in the molecular structure both nonionic functional group and cationic functional group.

The present invention is explained more in detail below.

The hydrazine derivative used in the invention is represented by the following Formula (1).

Formula ( 1 )

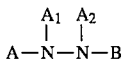

In Formula (1) A represents an aliphatic group (preferably a group having 1 to 30 carbon atoms, and more preferably a straight-chained, branched or cyclic alkyl group having 1 to 20 carbon atoms, such as a methyl, ethyl, t-butyl, octyl, cyclohexyl or benzyl group, each of which may have a substituent such as an aryl alkoxy, aryloxy, alkylthio, arylthio, sulfoxy, sulfonamide, acylamino, or ureido group), an aryl group (preferably a single or condensed ring group, for example, a benzene ring or a naphthalene ring), a heterocyclic group (preferably a single ring group or a condensed ring group containing a hetercycle having one hetero atom selected from a nitrogen, sulfur and oxygen atom, such as a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring or a furan ring). A preferably represents an aryl group or a heterocyclic group.

The aryl or heterocyclic group of A may have a substituent. The examples of the substituent include an alkyl group (preferably having 1 to 20 carbon atoms), an aralkyl group (preferably a single or condensed ring group having an alkyl group of 1 to 3 carbon atoms), an alkoxy group (preferably having an alkyl Group of 1 to 20 carbon atoms), a substituted amino group (preferably having an alkyl group or alkylidene group of 1 to 20 carbon atoms), an acylamino group (preferably having 1 to 40 carbon atoms), a sulfonamide group (preferably having 1 to 40 carbon atoms), a ureido group (preferably having 1 to 40 carbon atoms), a hydrazinocarbonylamino group (preferably having 1 to 40 carbon atoms), a hydroxy group or a phosphoamide group (preferably having 1 to 40 carbon atoms)

A preferably has at least one of a non-diffusible group and a group for promoting silver halide adsorption. The non-diffusible group is preferably a ballast group which is conventionally used in immobile photographic additives such as couplers, and the ballast group includes an alkyl, alkenyl, alkinyl or alkoxy group having not less than 8 carbon atoms or a phenyl, phenoxy or alkylphenoxy group, which is relatively inactive to photographic properties.

The group for promoting silver halide adsorption includes a thiourea, thiourethane, mercapto, thioether, thion, heterocyclic, thioamidoheterocyclic or mercaptoheterocyclic group or an adsorption group described in Japanese Patent O.P.I. Publication No. 64-90439/1989.

The example of B includes an acyl group (for example, formyl, acetyl, propionyl, trifluoroacetyl, methoxyacetyl, phenoxyacetyl, methylthioacetyl, chloroacetyl, benzoyl, 2-hydroxymethylbenzoyl, 4-chlorobenzoyl), an alkylsulfonyl group (for example, methanesulfonyl, chloroethanesulfonyl), an arylsulfonyl group (for example, benzenesulfonyl), an alkylsulfinyl group (for example, methanesulfinyl), an arylsulfinyl group (for example, benzenesulfinyl), a carbamoyl group (for example, methylcarbamoyl, phenylcarbamoyl), an alkoxycarbonyl group (for example, methoxycarbonyl, methoxyethoxycarbonyl), an aryloxycarbonyl group (for example, phenyloxycarbonyl), a sulfamoyl group (for example, dimethylsulfamoyl), a sulfinamoyl group (for example, methylsulfinamoyl), an alkylsulfonyl group (for example, methoxysulfonyl), a thioacyl group (for example, methylthiocarbonyl), a thiocarbamoyl group (for example, methylthiocarbamoyl), a group containing an oxalyl group (for example, an ethoxalyl group), or a heterocyclic group (for example, pyridinyl, pyridinium).

B in Formula (1) may form $—N{=}C(R_1)(R_2)$ together with $A_2$ and a nitrogen atom, wherein $R_1$ represents an alkyl group, an aryl group or a heterocyclic group, and $R_2$ represents a hydrogen atom, an alkyl group, an aryl group or a heterocyclic group.

B is preferably an acyl group or a group containing an oxalyl group.

$A_1$ and $A_2$ represent both hydrogen atoms or one of $A_1$ and $A_2$ represents a hydrogen atom and the other represents an acyl group (acetyl, trifluoroacetyl, benzoyl), a sulfonyl group (methanesulfonyl, toluenesulfonyl) or a group containing an oxalyl group (ethoxalyl).

Of the hydrazine compounds in the invention, the compound represented by the following Formula (2) is preferable:

Formula (2 )

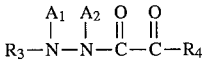

wherein $R_3$ represents an aryl group or a heterocyclic group, $R_4$ represents

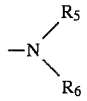

wherein $R_5$ and $R_6$ independently represent a hydrogen atom, an alkyl group, an alkenyl group, an alkinyl group, an aryl group, a heterocyclic group,i an amino group, a hydroxy group, an alkoxy group, an alkenyloxy group, an alkinyloxy group, an aryloxy group or a heterocyclicoxy group, provided that $R_5$ and $R_6$ may form a ring together with a nitrogen atom, $R_7$ represents a hydrogen atom, an alkyl group, an alkenyl group, an alkinyl group, an aryl group or a heterocyclic group, and $A_1$ and $A_2$ are the same as $A_1$ and $A_2$ of Formula (1), respectively.

The aryl group represented by $R_3$ is preferably a single or condensed ring group, for example, a benzene ring group or a naphthalene ring group.

The heterocyclic group represented by $R_3$ is preferably a single ring group or a condensed ring group containing a 5- or 6-membered heterocycle having one hetero atom selected from a nitrogen, sulfur and oxygen atom, such as a pyridine ring, a quinoline ring, a pyrimidine ring, a thiophene ring, a furan ring, a thiazole ring or a benzothiazole ring.

$R_3$ is preferably a substituted or unsubstituted aryl group. The substituent is the same as that of A in Formula (1), and preferably one having at least one sulfo group when a developer having pH of not more than 11.2 is used for high contrast.

$A_1$ and $A_2$ are the same as $A_1$ and $A_2$ of Formula (1), respectively, and are preferably simultaneously hydrogen atoms.

$R_5$ and $R_6$ in $R_4$ independently represent a hydrogen atom, an alkyl group (methyl, ethyl or benzyl), an alkenyl group (allyl, butenyl), an alkinyl group (propagyl, butinyl), an aryl group phenyl, naphthyl), a heterocyclic group (2,2,6,6-tetramethylpiperidinyl, N-benzylpiperidinyl, quinolidinyl, N,N'-diethylpyrazolidinyl, N-benzylpyrrolidinyl, pyridyl), an amino group (amino, methylamino, dimethylamino, dibenzylamino), a hydroxy group, an alkoxy group (methoxy, ethoxy), an alkenyloxy group (allyloxy), an alkinyloxy group (propagyloxy), an aryloxy group (phenoxy) or a heterocyclic group (pyridyl), provided that $R_5$ and $R_6$ may combine each other with a nitrogen atom to form a ring (piperidine, morpholine). $R_7$ represents a hydrogen atom, an alkyl group (methyl, ethyl, methoxyethyl or hydroxyethyl), an alkenyl group (allyl, butenyl), an alkinyl group (propagyl, butinyl), an aryl group phenyl, naphthyl), or a heterocyclic group (2,2,6,6-tetramethylpiperidinyl, N-methylpiperidinyl, pyridyl).

The Exemplified compounds represented by Formula (2) will be shown below, but the invention is not limited thereto.

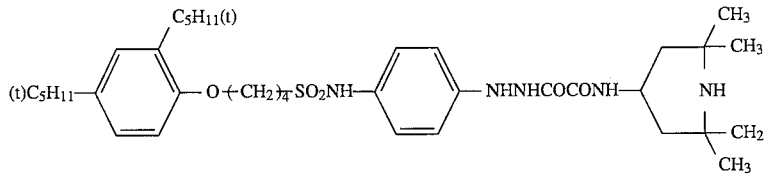

H-1

-continued
H-2
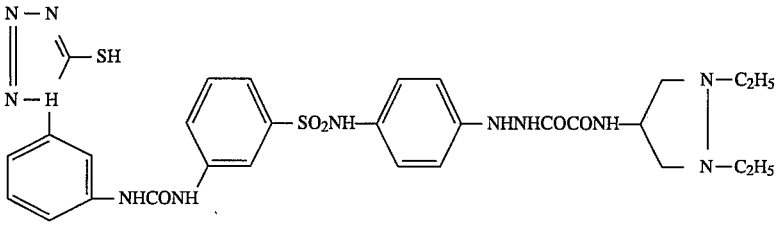
H-3
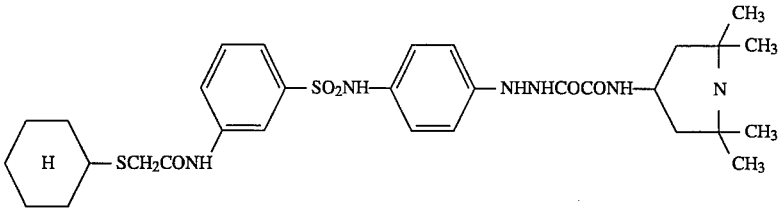
H-4
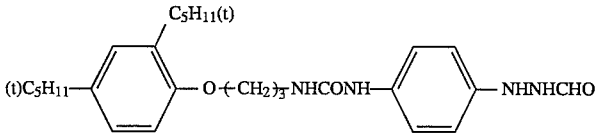
H-5
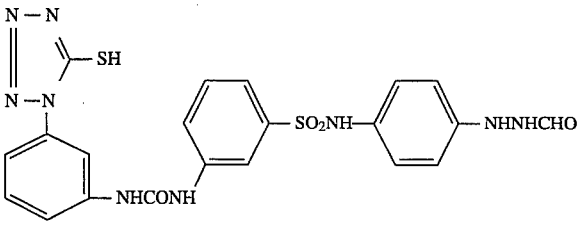
H-6
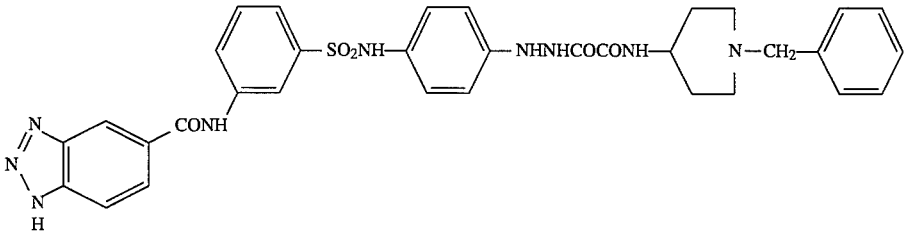
H-7
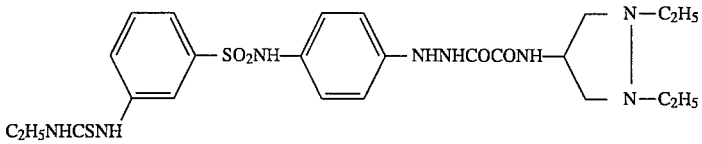
H-8
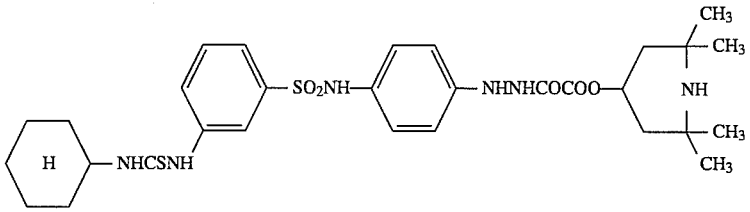
H-9
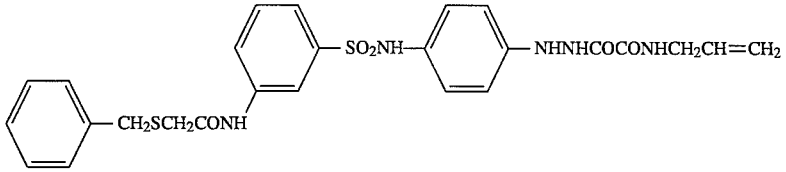

-continued
H-10
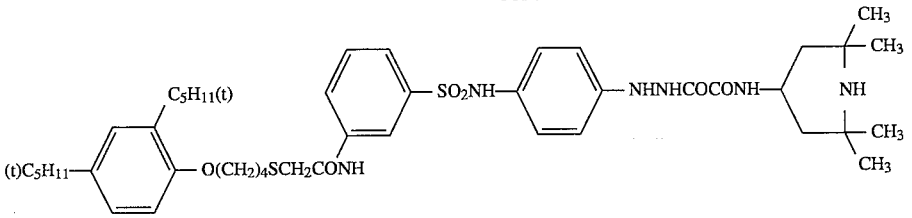
H-11
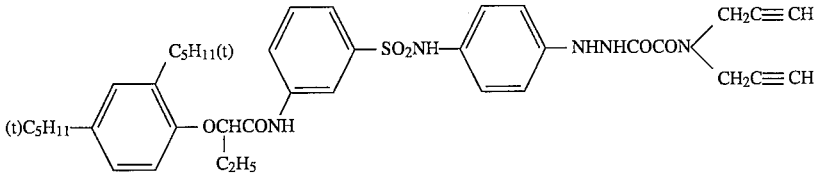
H-12
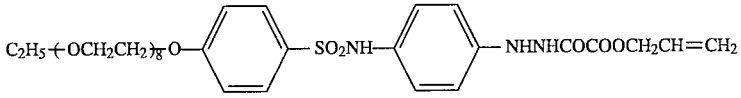
H-13
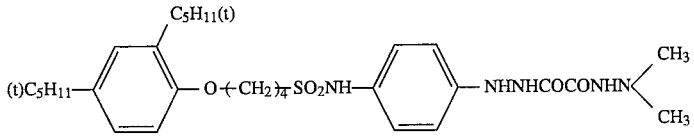
H-14
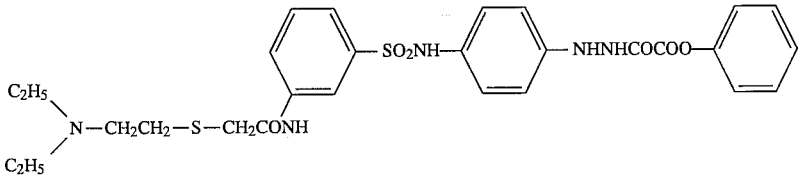
H-15
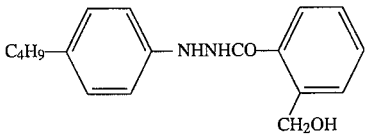
H-16
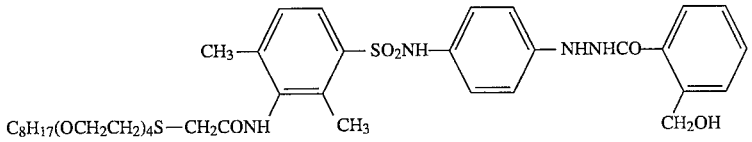
H-17
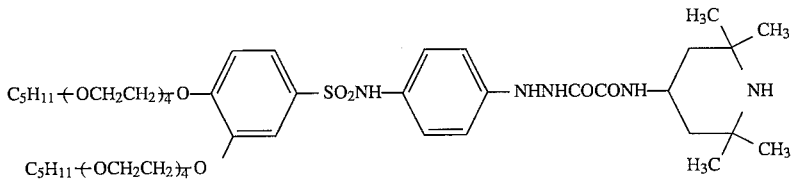
H-18
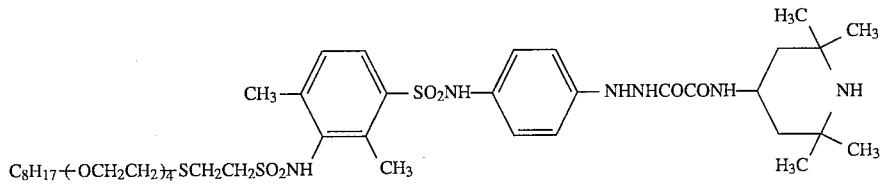

-continued
H-19
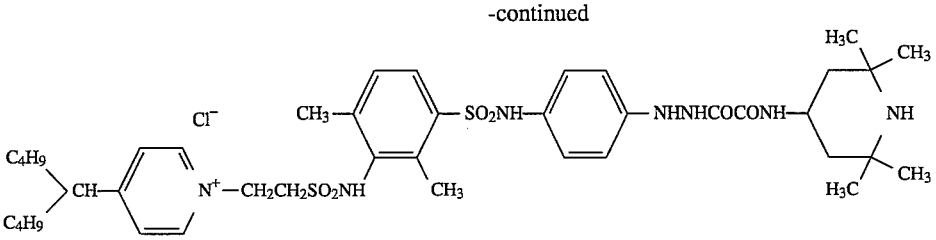
H-20
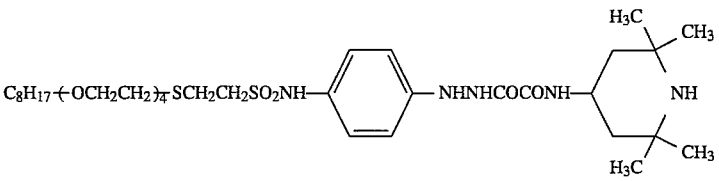
H-21
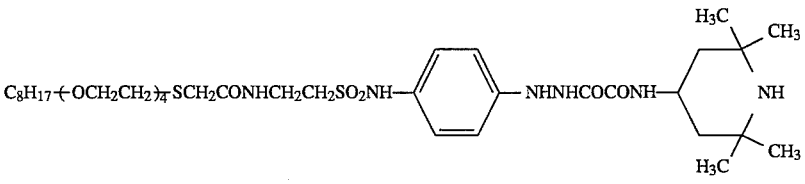
H-22
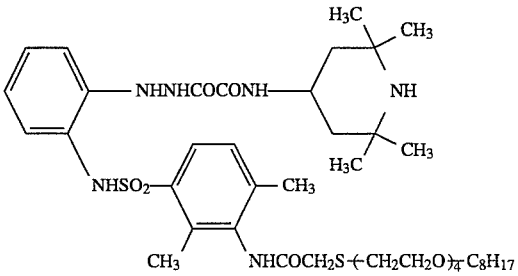
H-23
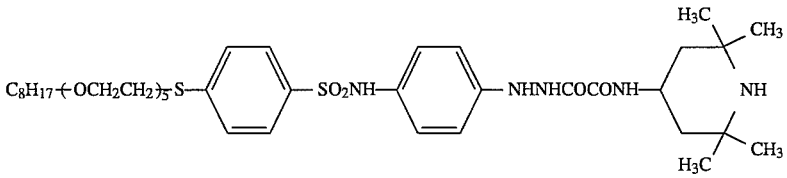
H-24
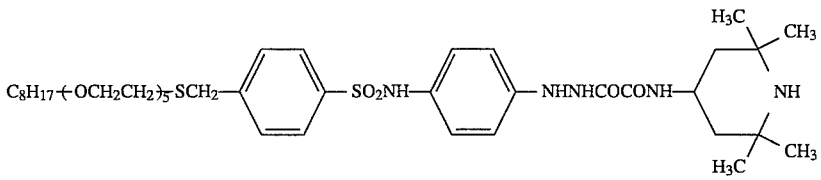
H-25
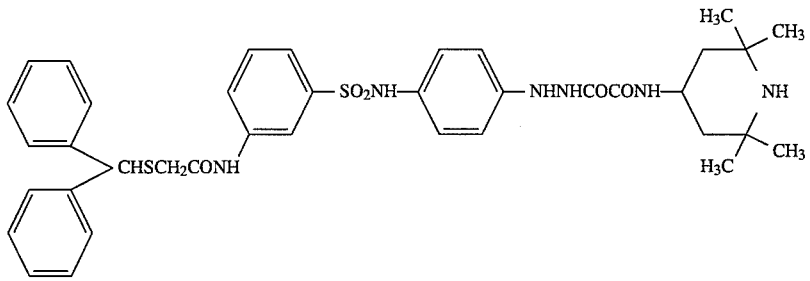

-continued

H-26

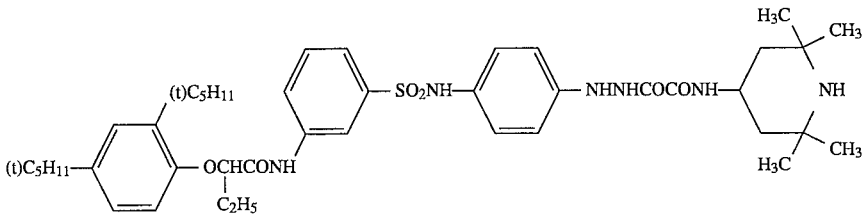

H-27

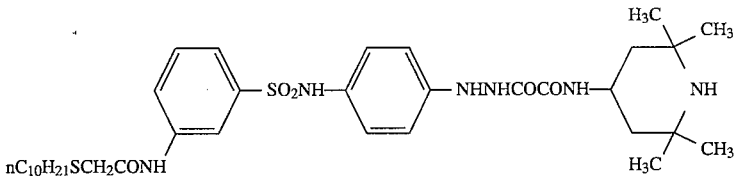

H-28

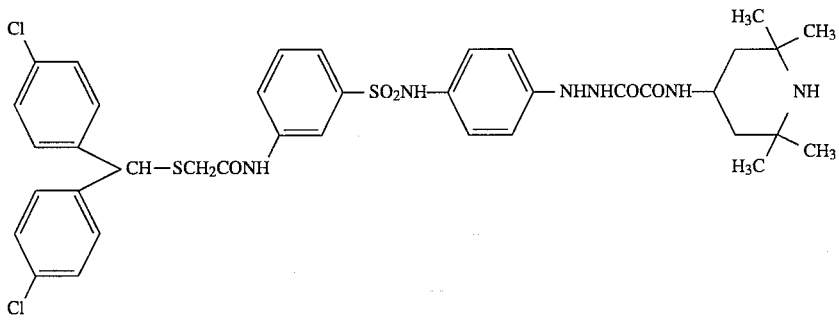

Besides the above compounds, the typical compounds include compounds 1-1 through 1-55 in columns 3 to 22 and 2-1 through 2-62 in columns 23 to 38 of U.S. Pat. No. 5,130,226 and compounds (1) through (76) in columns 3 to 18 of U.S. Pat. No. 5,158,856. Regarding the synthetic method of the compound represented by Formula (1) used in the invention Japanese Patent O.P.I. Publication Nos. 62-180361, 62-178246, 63-234245, 63-234246, 64-90439, 2-37, 2-841, 2-947, 2-120736, 2-230233 and 3-125134, U.S. Pat. Nos. 4,686,167, 4,988,604 and 4,994,365, European Patent Nos. 253,665 and 333,435 can be referred to.

The nucleation accelerating agent includes a compound represented by the following Formula (3) or (4):

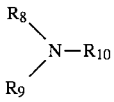

Formula (3)

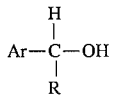

Formula (4)

In Formula (3) $R_8$, $R_9$ and R10 independently represent a hydrogen atom, an alkyl group, a substituted alkyl group, an alkenyl group, a substituted alkenyl group, an alkinyl group, a substituted alkinyl group, an aryl group or a substituted aryl group, provided that $R_8$, $R_9$ and $R_{10}$ may form a ring together and are not simultaneously hydrogen atoms. The preferable agent is an aliphatic tertiary amines. These compounds preferably have in the molecules an anti-diffusible group or a silver halide adsorption group. The compounds having anti-diffusible property have preferably a molecular weight not less than 100, and more preferably a molecular weight not less than 300. The preferable adsorption group includes a heterocyclic, mercapto, thioether, thion or thiourea group.

The Exemplified compounds will be shown below.

(Z-1)

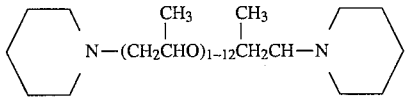

(Z-2)

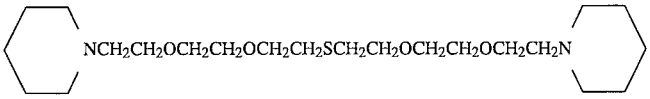

-continued (Z-3)

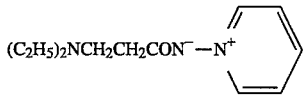

(Z-4)

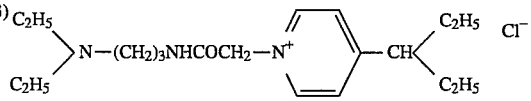

(Z-5)

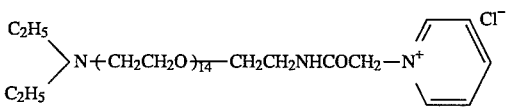

(Z-6)

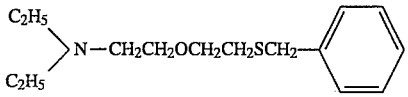

(Z-7)

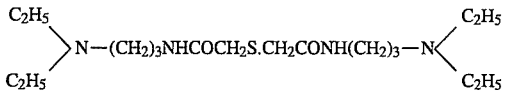

(Z-8)

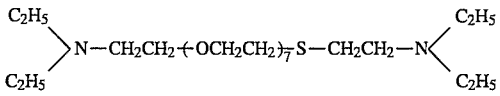

(Z-9)

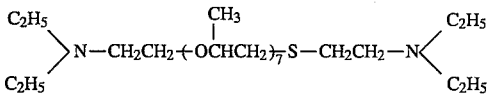

(Z-10)

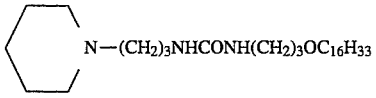

In Formula (4) Ar represents a substituted or unsubstituted aryl or aromatic heterocyclic group; and R represents a hydrogen atom in alkyl group, an alkenyl group, an alkinyl group or an aryl group, each of which may have a substituent. These compounds preferably have in the molecules an anti-diffusible group or a silver halide adsorption group. The compounds having anti-diffusible property have preferably a molecular weight not less than 120, and more preferably a molecular weight not less than 300.

The Exemplified compounds thereof will be shown below.

The content of the compound of the invention represented by Formula (1) or (2) or Formula (3) or (4) is preferably $5\times10^{-7}$ to $5\times10^{-1}$ mol/mol of silver halide, and more preferably $5\times10^{-6}$ to $5\times10^{-2}$ mol/mol of silver halide.

In the invention hydrazine derivatives or nucleation accelerating agents are contained in a silver halide emulsion layer or a hydrophilic colloid layer other than the emulsion layer, and preferably in a Silver halide emulsion layer or a hydrophilic colloid layer adjacent to the emulsion layer. The hydrazine derivatives or nucleation accelerating agents are preferably contained in the same layer or an adjacent layer.

Z-11

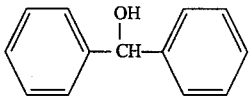

Z-12

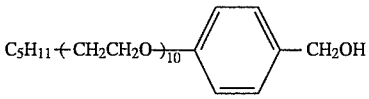

Z-13

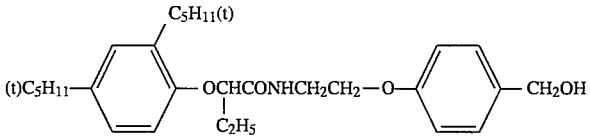

Z-14

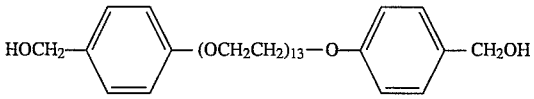

Z-15

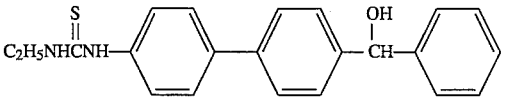

Z-16

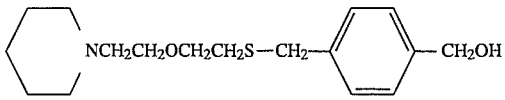

Z-17

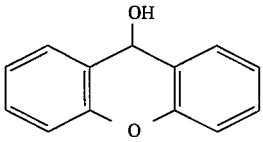

Z-18

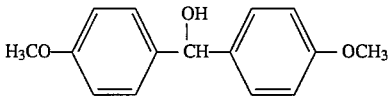

Z-19

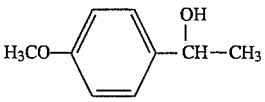

Z-20

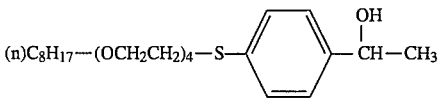

Besides the above compounds, the typical compounds include those disclosed in U.S. Pat. Nos. 4,777,118 and 4,851,321 and Japanese Patent O.P.I. Publication No. 4-56949.

Further, the hydrazine derivatives are more preferably contained in a silver halide emulsion layer.

The latex of the invention can be obtained by the following method:

1) The resin obtained by polymerizing a polymerizable unsaturated compound or a solution obtained by dissolving the resin in a water-miscible organic solvent is dispersed in water or a water-miscible organic solvent containing water, and the hydrophilic polymer of the invention is added thereto to obtain latex.
2) The resin obtained by polymerizing a polymerizable unsaturated compound or a solution obtained by dissolving the resin in a water-miscible organic solvent is dispersed in an aqueous solution in which the hydrophilic polymer of the invention is dissolved to obtain latex.
3) The polymerizable unsaturated compound is emulsion-polymerized in water using a small amount of a surfactant to obtain an emulsion and the hydrophilic polymer of the invention is added to the emulsion to obtain latex.
4) The hydrophilic polymer of the invention is dissolved in water or an aqueous solution containing a water-miscible organic solvent and a polymerizable unsaturated compound is added to the solution and polymerized to obtain latex.

In method 3), after the addition of the hydrophilic polymer of the invention, the emulsion is heated to not less than 50° C. and then cooled to obtain a more stable latex.

Of the above methods, in order to obtain a stable latex containing polymer particles having a uniform particle size, the method 4) is preferable.

The hydrophilic polymer in the invention includes a polymer having in its chemical structure both nonionic group and anionic group or a water-soluble natural polymer.

The hydrophilic polymer in the invention refers to one having a solubility of not less than 0.05 g in 100 g water at 20° C.

The hydrophilic polymer in the invention having both nonionic group and anionic group includes one having in its chemical structure a nonionic group such as an ether, ethyleneoxide or hydroxy group and an anionic group such as a sulfonic acid group or its salt, a carboxyl group or its salt or a phospholic acid group or its salt. The hydrophilic polymer preferably has both ethyleneoxide group and a sulfonic acid group and has the solubility of not less than 0.1 g in water.

The hydrophilic polymer having both nonionic group and anionic group may have a third group in addition to the above nonionic and anionic groups. The hydrophilic polymer contain the nonionic and anionic groups in an amount of not less than 10 mol % and preferably 30 mol %. The examples thereof will be shown below. m and n represent mol %.

| | | | | average molecular weight (Mn) |
|---|---|---|---|---|
| A-1 | $\leftarrow CH_2-CH\rightarrow_{40}$ (COOCH$_2$CH$_2$OH) <br> $\leftarrow CH_2-C(CH_3)\rightarrow_m$ (COOCH$_2$CH$_2$OH) | | $\leftarrow CH_2-CH\rightarrow_{60}-CH_3$ (CONHC(CH$_3$)CH$_2$SO$_2$Na) <br> $\leftarrow A\rightarrow_n$ | 8000 |
| | m | n | —A— | |
| A-2 | 50 | 50 | $\leftarrow CH_2-CH\rightarrow$ (COOH) | 7300 |
| A-3 | 50 | 50 | $\leftarrow CH_2-CH\rightarrow$ (C$_6$H$_4$SO$_3$Na) | 11500 |
| A-4 | 40 | 60 | $\leftarrow CH_2-CH\rightarrow$ (CONHC(CH$_3$)CH$_2$SO$_3$Na) | 5300 |
| A-5 | $\leftarrow CH_2-C(CH_3)\rightarrow_{40}$ (COOCH$_2$CH$_2$OH) | $\leftarrow CH_2-CH\rightarrow_{30}$ (C$_6$H$_4$SO$_3$Na) | $\leftarrow CH_2-CH\rightarrow_{30}$ (COOC$_4$H$_9$) | 14300 |

Besides the above compounds, the typical compounds include P-1 through P-19 disclosed on pages 289 and 290 of Japanese Patent O.P.I. Publication No. 62-10363.

Examples of the water-soluble natural polymer used in the invention include those other than geletin which are described in details in Collectives of Technological Data (Keiei Kaihatsu Center) for water-dispersed water-soluble polymer resins, and preferably lignin, starch, pullulan, cellulose, alginic acid dextran, dextrin, guar gum, gum arabic, glycogen, laminarin, lichenin, nigellone and derivatives thereof.

The derivatives of the water-soluble natural polymers are preferably those sulfonated, carboxylated, phosphorylated, sulfoalkylated, carboxyalkylated or alkyl-phosphorylated and salts thereof.

In the invention, the above water-soluble natural polymers may be used in combination of two or more kinds. Of water-soluble natural polymers, glucose polymers or their derivatives are preferable. Of glucose polymers or their derivatives, starch, glycogen, lichenin, dextran and nigellone are preferable, and dextran or its derivative is especially more preferable. The examples of dextrans include those on page 286, on lower right side to page 287 on lower right side of Japanese Patent O.P.I. Publication No. 62-90645.

The latex used in the invention is comprised of a hydrophobic polymer and the hydrophilic polymer of the invention as a protective colloid, and the hydrophobic polymer is divided into a polycondensation polymer and a vinyl type polymer. The polycondensation polymer includes polyamide, polypeptide, polyester, polycarbonate, polyacid anhydride, polyurethan, polyurea and polyether. An unsaturated compound type polymer includes a polymer obtained by addition polymerization of a vinyl monomer, for example, a homopolymer or copolymer of an aliphatic hydrocarbon type, aromatic type, vinyl alcohol type, nitrile type, acryl type, methacryl type, acrilonitrile type or halogen type monomer.

The hydrophobic polymer has a number average molecular weight of 1,000 to 1,000,000, a grass transition temperature (Tg) of preferably −150° to 150° C. and an average particle diameter of 0.01 to 1 μm, preferably 0.01 to 0.5 μm.

Any hydrophobic polymer can be contained stably in a hydrophilic colloid layer in combination use of the hydrophilic polymer of the invention as a protective colloid. The composition is not limited in view of photographic properties, however, polyester or a vinyl type polymer is preferable in view of easiness of production. The polymerizable unsaturated compound which is a raw material of these polymers may be a polymerizable ethylenically unsaturated compound or a diolefin. The examples thereof include the following compounds:

acrylic acid or acrylates including ethyl acrylate, isopropyl acrylate, sec-butyl acrylate, amyl acrylate, 2-ethylhexyl acrylate, tert-octyl acrylate, 4-chlorobutyl acrylate, cyanoethyl acrylate, 2-acetoxyethyl acrylate, dimethylaminoethyl acrylate, benzyl acrylate, 2-chlorohexyl acrylate, furfuryl acrylate, phenyl acrylate, 2,2-dimethyl-3-hydroxypropyl acrylate, 2-butoxyethyl acrylate, ω-methoxypolyethylene glycol acrylate (addition molar number n=9) and 1,1-dichloro-2-ethoxyethyl acrylate; methacrylic acid or methacrylates including n-propyl methacrylate, iso-butyl methacrylate, cyclohexyl methacrylate, chlorobenzyl methacrylate, N-ethyl-N-phenylaminoethyl methacrylate, tetrahydrofurfuryl methacrylate, cresyl methacrylate, naphthyl methacrylate, triethyleneglycol monomethacrylate, 2-acetoacetoxyethyl methacrylate and 2-(2-butoxyethoxy)ethyl methacrylate; crotonic acid or crotonates including butyl crotonate; vinyl esters including vinyl acetate, vinyl caproate, vinylphenyl acetate, vinyl benzoate and vinyl salicylate; maleic acid or maleic acid diesters including diethyl maleate; fumaric acid or fumaric acid diesters including dimethyl fumarate; itaconic acid or itaconic acid diesters including dibutyl itaconate; olefins including dicyclopentadiene, propylene, 1-pentene, vinyl chloride, vinylidene chloride, chloroprene and 2,3-dimethylbutadiene; styrenes including styrene, trimethylstyrene, isopropylstyrene, acetoxystyrene, dichlorostyrene and vinyl methyl benzoate; acrylamides including acrylamide, tertbutylacrylamide, cyclohexylacrylamide, benzylacrylamide, dimethylaminoethylacrylamide, β-cyanoethylacrylamide and N-(2-acetacetoxyethyl)acrylamide; methacrylamides including methacrylamide, butylmethacrylamide, hydroxymethylmethacrylamide, methoxyethylmethacrylamide, dimethylaminoethylmethacrylimide and diethylmethacrylamide; allyl compounds including allyl caproate and allyl benzoate; vinyl ethers including hexylvinyl ether and dimethylaminovinyl ether; vinyl ketones including methylvinyl ketone, phenylvinyl ketone and methoxyethylvinyl ketone; polyfunctional monomers including divinylbenzene, methylenebisacrylamide and ethyleneglycol dimethacrylate; vinylheterocyclic compounds including vinyl-pyridine, N-vinylimidazole, N-vinyloxazolidone, N-vinyltriazole and N-vinylpyrrolidone; glycidyl esters including glycidyl methacrylate; and unsaturated nitriles including acrylonitrile.

Further, there may be mentioned of a monoalkyl itaconate, a monoalkyl maleate, citraconic acid, styrene sulfonic acid, vinylbenzyl sulfonic acid, vinyl sulfonic acid, acryloyloxyalkyl sulfonic acid, acrylamidealkyl sulfonic acid, methacrylamidealkyl sulfonic acid, acryloyloxyalkyl phosphate, and sodium 3-allyloxy-2-hydroxypropanesulfonate having two hydrophilic group. These acids may be an alkali metal or ammonium salt.

Besides the above compounds, the other polymerizable unsaturated compounds include a cross-linkable monomer disclosed in U.S. Pat. Nos. 3,459,790, 3,438,708, 3,554,987, 4,125,195 and 4,247,673 and Japanese Patent O.P.I. Publication Ns. 57-205735.

The above compounds include a water-soluble compound, and the water-soluble compound is copolymerized with a hydrophobic monomer to form a hydrophobic polymer.

The polymerization initiator of vinyl type compound includes azo compounds such as azobisbutyronitrile, 2,2'-azobis(2,4-dimethylvaleronitrile), 2,2'-azobisdimethylisobutyrate, 2,2'-azobis(4-methoxy-2,4-dimethylvaleronitrile), 1,1'-azobis(cyclohexanone-1-carbonitrile)dimethyl, 2,2'-azobisisobutyrate, 4,4'-azobis-4-cyanovaleric acid, 4,4'-azobis-4-cyanovaleric acid sodium salt and 2,2'-azobis(2-aminopropane)hydrochloride, peroxides such as benzoylperoxide, laurylperoxide, cumenehydroperoxide, diisopropylperoxycarnate, t-butylhydroperoxide, di-tertbutylperoxide, dicumylperoxide and hydrogen peroxide, persulfates such as potassium persulfate, ammonium persulfate and sodium persulfate, potassium bromate and ammonium cerium (IV) nitrate.

The peroxides or persulfates can be used as a redox initiator in combination use of a reducing agent. The initiator is preferably a water-soluble one.

The production method is preferably a suspension polymerization or an emulsion polymerization in view of less production processes.

In the invention, the latex content-of the hydrophilic layer is preferably 10 to 300% by weight, and more preferably 15 to 200% by weight based on the gelatin content of the layer in terms of polymer content of the latex. The polymer content herein referred to excludes the content of the hydrophilic polymer as a protective colloid.

The latex of the invention is contained in a silver halide emulsion layer and/or a hydrophilic colloid layer other than the emulsion layer, and preferably in a silver halide emulsion layer and/or a hydrophilic colloid layer adjacent to the emulsion layer.

The hydrophilic polymer used in the invention accounts for preferably 0.1 to 30% by weight, and more preferably 0.5 to 15% by weight based on the polymer in the latex. The hydrophilic polymer is used in the same amount as above on emulsion polymerization.

The molecular weight of the hydrophilic polymer is 1,000 to 1,000,000, and preferably 2,000 to 200,000. The molecular weight referred to herein is a number average molecular weight, and is measured using gel permeation chromatography HLC-802A produced by Toyo Soda Co. Ltd. in terms of standard polystyrene.

The preferable method of producing the latex of the invention will be described below.

The hydrophilic polymer is dissolved in water or in an aqueous solution containing a water-miscible organic solvent, heated and degassed with stirring, and then heated to a specific temperature. Then, a polymerization initiator is added thereto and a polymerizable unsaturated compound is added or added dropwise. Thereafter, polymerization is carried out for a predetermined period and cooled.

The hydrophilic polymer may be dissolved in water or in an aqueous solution containing a water-miscible organic solvent after heated or degassed, and a polymerization initiator may be added before heated or degassed.

The synthetic examples of latexes in the invention will be described below.

1. Synthetic Examples of the latex comprising a hydrophilic polymer having both nonionic group and anionic group Synthesis of examplified polymer A-4

In a three-neck flask were put 52 g (0.40 mol) of hydroxyethylmethacrylate, 137 g (0.60 mol) of 2-acrylamide-2-methylpropanesulfonic acid sodium salt, 5.0 g of 4,4-azobis(4-cyanovaleic acid and 500 ml of a degassed water-ethanol (80/20 volume %) solution and the mixture was reacted at 80° C. for 10 hours. After the reaction, the reaction mixture was poured into a large amount of acetone with vigorous stirring to obtain precipitate. The precipitate was filtered out, washed with acetone, and dried at 60° C. to obtain A-4. The yield was 180 g (95%) and the number average molecular weight (Mn) was 5,300.

Synthetic Example 1-1

In a 1,000 ml four-neck flask equipped with a stirrer, a thermometer, a dropping funnel, a nitrogen conduction pipe and a reflux condenser 350 ml of water were put and heated to 80° C. while introducing a nitrogen gas. After the temperature reached 80° C., the additional nitrogen gas was further introduced. Then, to this were added 4.5 g of A-4 and 0.45 g of ammonium persulfate as a polymerization initiator. Thereafter, polymerization was carried out by adding thereto 40 g of butyl acrylate and 50 g of styrene dropwise through the dropping funnel in about an hour. The reaction mixture was cooled five hours after the addition of the polymerization initiator and adjusted to a pH of 6 with ammonia water. The resulting mixture was filtered out to remove insoluble or large particles to obtain the latex (a).

Synthetic Example 1-2

The polymerization was carried out in the same manner as in Synthetic Example 1, except that 39.5 g of butyl acrylate, 49.5 g of styrene and 1 g of acrylic acid were used. Thus, the latex (b) was obtained.

Synthetic Example 1-3

The polymerization was carried out in the same manner as in Synthetic Example 1, except that 90 g of ethyl acrylate as a polymerizable unsaturated compound and potassium persulfate as a polymerization initiator were used. Thus, the latex (c) was obtained.

Synthetic Example 1-4

The polymerization was carried out in the same manner as in Synthetic Example 1, except that A-3 was used instead of A-4. Thus, the latex (d) was obtained.

Synthetic Example 1-5

The polymerization was carried out in the same manner as in Synthetic Example 2, except that A-3 was used instead of A-4. Thus, the latex (e) was obtained.

Synthetic Example 1-6

The polymerization was carried out in the same manner as in Synthetic Example 3, except that A-3 was used instead of A-4. Thus, the latex (f) was obtained.

A nitrogen gas was introduced in an autoclave, and the autoclave was charged with 55 parts by weight of styrene, 42 parts by weight of butadiene, 3 parts by weight of glycidyl methacrylate, 3 parts by weight of A-4, 0.2 parts by weight of tertiary-dodecylmercaptan, 0.3 parts by weight of potassium triphosphate, 0.3 parts by weight of ammonium persulfate, and 100 parts by weight of water. The polymerization reaction was carried out at 50° C. and at 5 atmospheres for 18 hours. After the polymerization reaction, any unreacted monomer was removed by steam distillation. Thus, the latex (g) was obtained.

Synthetic Example 1-8

The reaction vessel equipped with a stirrer, a thermometer, a nitrogen conduction pipe, a distillation apparatus and a heater was charged with 192.1 g (1.0 mol) of anhydrous trimellitic acid, 62.1 g (1.0 mol) of ethylene glycol and 108.1 g (1.0 mol) of benzyl alcohol. The mixture was heated to 150° C., and kept at 150° C. for 4 hours with stirring. Thereafter, while removing water, the resulting mixture was heated to 190° C. over a period of about 9 hours, and further heated to 205° C. The thus obtained polyester was removed, cooled and solidified.

One hundred gram of the above obtained polyester was dissolved in 250 ml of acetone. The solution was gradually poured into 100 ml of an about 0.1 mol A-1 aqueous solution with vigorous stirring. The resulting mixture was filtered out and the acetone was removed by heating to 60° C. Thus, the latex (h) was obtained.

2. Synthetic Examples of the latex comprising a water-soluble natural polymer

Synthetic Example 2-1

Three hundred and fifty milliliters of water and 4.5 g of dextran sulfate sodium salt were put in a 1,000 ml four-neck flask equipped with a stirrer, a thermometer, a dropping funnel, a nitrogen conduction pipe and a reflux condenser and heated to 80° C. while introducing a nitrogen gas. The dextran sulfate sodium salt was prepared from dextran having an intrinsic viscosity of 0.210 according to the method described in synthetic example i of Japanese Patent Publication No. 45-12820. After the temperature reached 80° C., the nitrogen gas was further introduced. Then, to this were added 10 cc of an aqueous solution containing 0.45 g of ammonium persulfate as a polymerization initiator. Thereafter, polymerization was carried out by adding thereto a mixture of 40 g of butyl acrylate and 50 g of styrene dropwise through the dropping funnel in about an hour. The reaction mixture was cooled five hours after the addition of the polymerization initiator and adjusted to a pH of 6 with ammonia water. The resulting mixture was filtered out to remove insoluble or large particles to obtain the latex (a).

Synthetic Example 2-2

The polymerization was carried out in the same manner as in Synthetic Example 1, except that 39.5 g of butyl acrylate, 49.5 g of styrene and 1 g of acrylic acid were used. Thus, the latex (b) was obtained.

Synthetic Example 2-3

The polymerization was carried out in the same manner as in Synthetic Example , except that 90 g of ethyl acrylate as a polymerizable unsaturated compound, 0.45 g of potassium persulfate as a polymerization initiator and 0.22 g of sodium hydrogen sulfite were used the polymerization temperature was 40° C. Thus, the latex (c) Was obtained.

Synthetic Example 2-4

The polymerization was carried out in the same manner as in Synthetic Example 4, except that 85 g of ethyl acrylate and 5 g of 2-acrylamide-2-methylpropanesulfonic acid was used. Thus, the latex (d) was obtained.

Synthetic Example 2-5

The polymerization was carried out in the same manner as in Synthetic Example 1, except that 13.5 g of dextran sulfate sodium salt were used. Thus the latex (e) was obtained.

Synthetic Example 2-6

Ninety milliliters of dioxane were put in a 300 ml four-neck flask equipped with a stirrer, a thermometer, a nitrogen conduction pipe and a reflux condenser and heated to 70° C. while introducing a nitrogen gas. After the nitrogen gas was introduced for another 30 minutes were added 60 g of butyl acrylate, 30 g of styrene and 10 cc of a dioxane solution containing 0.3 g of azobisisobutyronitrile as a polymerization initiator. Thereafter, polymerization was carried out at 70° C. for 7 hours.

In a mixture solvent of 240 cc of water and 120 cc of ethanol 4.5 g of dextran sulfate sodium salt were dissolved at 70° C. The resulting solution was added to the above polymerization mixture with vigorous stirring and cooled. Thus, the latex (f) was obtained.

Synthetic Example 2-7

The autoclave with a stirrer was substituted by a nitrogen gas and charged with 55 parts by weight of styrene, 42 parts by weight of butadiene, 3 parts by weight of glycidyl methacrylate, 3 parts by weight of the sulfate salt, 0.2 parts by weight of tertiary-dodecylmercaptan, 0.3 parts by weight of potassium triphosphate, 0.3parts by weight of ammonium persulfate, and 100 parts by weight of water. The polymerization reaction was carried out at 50° C. and at a pressure of 5 atmosphere for 18 hours. After the polymerization reaction, any unreacted monomer was removed by steam distillation. Thus, the latex (g) was obtained.

Synthetic Example 2-8

The reaction vessel equipped with a stirrer, a thermometer, a nitrogen conduction pipe, a distillation apparatus and a heater was charged with 192.1 g (1.0 mol) of anhydrous trimellitic acid, 62.1 g (1.0 mol) of ethylene glycol and 108.1 g (1.0 mol) of benzyl alcohol. The mixture was heated to 150° C., and kept at 150° C. for 4 hours with stirring. Thereafter, water was removed and the resulting mixture was gradually heated to 150° C. over a period of about 9 hours, and further heated to205° C. Thus obtained polyester was taken out, cooled and solidified.

The above obtained polyester of 100 g was dissolved in 250 ml of acetone. The solution was gradually poured into 100 ml of an aqueous about 0.1 mol ammonia solution containing 2.5 g of dextran sulfate sodium salt with vigorous stirring. The resulting mixture was filtered out and the acetone was removed by heating to 60° C. Thus, the latex (h) was obtained.

As shown in the above production examples 2-1 through 2-8, hydrophobic vinyl monomers can be well emulsion-polymerized in an aqueous solution containing a glucose polymer or its derivative without using the conventional emulsifying agent. It has been proved from the above that these compounds are sufficiently effective as a protective colloid.

The latex of the invention may be added to any of a silver halide emulsion layer, a protective layer, an intermediate layer, an anti-halation layer, a subbing layer, a backing layer, a mordant layer or a neutralizing layer.

In the light-sensitive material in the invention at least one conductive layer is preferably provided on a support. As a method of forming a conductive layer there is a method of forming it using a water soluble conductive polymer, a hydrophobic polymer and a hardener or a method of forming it using metal oxides. Regarding this method, the method described on pages 5 to 15 of Japanese Patent O.P.I. Publication No. 3-265842 can be used.

In a silver halide emulsion applicable to the invention, any silver halide applicable to a common silver halide emulsion can be used, such as silver bromide, silver iodobromide, silver iodochloride, silver chlorobromide, and silver chloride. Among these silver halides, it is preferable to use silver chlorobromide, silver silver bromide, or silver iodobromide or silver iodochlorobromide each having a silver iodide content of not more than 4 mol %.

It is also preferable to use a monodisperse type grain having a variation coefficient of not higher than 15%. Such a variation coefficient is represented by (Standard deviation of grain sizes)/(Average grain Size)×100.

The light-sensitive material used in the invention preferably has a total gelatin content of not more than 3.5 g/m$^2$ on the silver halide emulsion layer side. The silver halide emulsion layer side refers to the side having a silver halide emulsion layer of a support and comprises a silver halide emulsion layer and other layers. The other layers include an emulsion protective layer, an anti-halation layer, a UV absorbing layer, an intermediate layer, a conductive layer and a hydrophilic layer containing a redox compound capable of releasing a development inhibitor on oxidation reaction. The total gelatin content of a silver halide emulsion layer and other layers is preferably not more than 3.5 g/m$^2$, and more preferably 0.5 to 3.3 g/m$^2$.

A silver halide emulsion of the invention can be applied with various techniques and additives each well-known in the art.

For example, a silver halide photographic emulsion and a backing layer each applicable to the invention may also contain a variety of a chemical sensitizer, a color toner, a layer hardener, a surfactant, a thickener, a plasticizer, a lubricant, a development inhibitor, a UV absorbent, an anti-irradiation dye, a heavy metal and a matting agent, in various methods. A silver halide photographic emulsion and a backing layer each applicable to the invention may further contain a polymer latex.

The above-mentioned additives are further detailed in Research Disclosure, Vol. 176, Item/7643, (December, 1978) and, ibid., Vol. 187, Item/8716, (November, 1979). The pages and columns where the additives are described will collectively be shown below.

| Additive | RD/7643 | RD/8716 |
|---|---|---|
| 1. Chemical sensitizer | p.23 | p. 648, r. col. |
| 2. Sensitivity increaser | | " |
| 3. Spectral sensitizer | pp. 23~24 | p. 648, r. col. |
| Supersensitizer | | p. 649, r. col. |
| 4. Whitening agent | p. 24 | |
| 5. Antifoggant & stabilizer | pp. 24~25 | p. 649, r. col. |
| 6. Light absorbent & | pp. 25~26 | p. 649, r. col. |
| filter dye | | p. 650, l. col. |
| UV absorbent | | |
| 7. Antistaining agent | p. 25, r. col. | p. 650, l~r. col. |
| 8. Dye-image stabilizer | p. 25 | |
| 9. Layer hardener | p. 26 | p. 651, l. col. |
| 10. Binder | p. 26 | " |
| 11. Plasticizer & lubricant | p. 27 | p. 650, r. col. |
| 12. Coating aid & surfactant | pp. 26~27 | " |
| 13. Antistatic agent | p. 27 | " |

In a silver halide photographic light-sensitive material of the invention, a support applicable thereto include, for example those made of a polyester such as cellulose acetate, cellulose nitrate and polyethylene terephthalate, polyolefin such as polyethylene, polystyrene, baryta paper, polyolefin-coated paper, glass and metal. These supports may be subbed, if required.

The exposed silver halide photographic light-sensitive material in the invention can be developed by various methods, for example, the conventional method.

The developing agent used in the invention include dihydroxy benzenes (for example, hydroquinone, chlorehydroquinone, bromohydroquinone, 2,3-dichlorohydroquinone, methylhydroquinone, isopropylhydroquinone or 2,5-dimethylhydroquinone), 3-pyrazolidone (for example, 1-phenyl-3-pyrazolidone, 1-phenyl-4-methyl-3-pyrazolidone, 1-phenyl-4,4'-dimethyl-3-pyrazolidone, 1-phenyl-4-ethyl-3-pyrazolidone or 1-phenyl-5-methyl-3-pyrazolidone), aminophenols (for example, o-aminophenol, p-aminophenol, N-methyl-p-aminophenol or 2,4-diaminophenol), pyrogallol, ascorbic acid, 1-aryl-3-pyrazolines (for example, 1-(p-hydroxyphenyl)-3-aminopyrazoline, 1-(p-methylaminophenyl)-3-aminopyrazoline, or 1-(p-amino-n-methlphenyl)-3-aminopyrazoline. They may be used singly or in combination. The combination of 3-pyrazolidones with dihydroxy benzenes or the combination of aminophenols with dihydroxy benzenes is preferable. The amount used of the developing agent is 0.01 to 1.4 mol per liter of developer.

The sulfites or metabisulfites as preservatives include sodium sulfite, potassium sulfite, ammonium sulfite and sodium metabisulfite. The amount used of the sulfite is not less than 0.25 mol per liter, and preferably not less than 0.4 mol per liter of developer.

As silver sludge preventing agents, compounds as described in Japanese Patent Publication No. 62-4702 and Japanese Patent O.P.I. Publication Nos. 1-319031, 3-51844, 4-26838 and 4-362942 can be added to developer. The developer may containing imidazols as a silver halide solvent or a developer containing the silver halide solvent and additives such as indazoles or triazols. Besides the above compounds the developer optionally contains alkali agents (sodium hydroxide or potassium hydroxide), pH buffering agents (for example, carbonates, phosphates, borates, boric acid, acetic acid, citric acid or alkanolamines), auxiliary solubility agents (for example, polyethylene glycols or salts thereof or alkanol amines), sensitizing agents (for example, non-ionic surfactant including polyoxy ethylenes or quaternary ammonium salts), surfactants, anti-foggants (for example, halides such as potassium bromide and sodium bromide, nitro benzindazole, nitro benzimidazole, benzotriazoles, benzothiazoles, tetrazoles or thiazoles), chelating agents (for example, ethylenediaminetetraacetic acid or an alkali metal salt thereof, nitrilotriacetic acid salts or polyphosphoric acid salts), development accelerators (for example, compounds described in U.S. Pat. No. 2,394,025 and Japanese Patent Publication No. 47-45541), hardeners (for example, glutaraldehyde or an bisulfite adduct thereof) or anti-foaming agents. The pH of developer is preferably adjusted to be 9.5 to 12.0.

As a particular case in which the developing agent is contained in the light sensitive material, for example, in the emulsion layer, the light sensitive material is developed with an alkali solution, which is an activater processing solution. Such a development is often used as one of the rapid processes in combination with silver stabilizing treatment of a thiocyanate, and the compounds of the invention can be applied thereto. In such a rapid process, the invention exhibits desirable effects.

A fixer having a conventional composition can be used. The fixer is usually an aqueous solution comprised of a fixing agent and other additives, and has a pH of 3.8 to 5.8. As the fixing agent thiosulfates such as sodium thiosulfate, potassium thiosulfate or ammonium thiosulfate, thiocyanates such as sodium thiocyanate, potassium thiocyanate or ammonium thiocyanate, or organic sulfur compounds capabe of producing soluble stable silver complexes can be used.

To the fixer can be added water soluble aluminum salts acting as a hardener such as alminium chloride, aluminium sulfate and potash alum. To the fixer can be optionally added preservatives such as sulfite is or metabisulfites, pH buffering agents (for example, acetic acid), pH regulators (for example, sulfuric acid) or chelating agents capable of softening hard water.

The developer may be a mixture of solid components, an organic solution containing glycol or amines or a viscous pasty liquid having a high viscosity. The development temperature in the invention may be within a conventional range of 20° to 30° C., or within a higher range of 30° to 40° C.

The black-and-white silver halide photographic light-sensitive material in the invention is preferably processed using an automatic developing apparatus. On development the material is processed while replenising a specific amount of developer replenisher in proportion to the area of the material processed. The developer replenishing amount is not more than 250 ml per $m^2$ of the material processed in view of reducing waste solution, preferably 75 to 200 ml per $m^2$ of the material processed, and more preferably 75 to 150 ml per $m^2$ of the material processed. Developer replenishing amount less than 75 ml per $m^2$ of the material processed results in desensitizing and low contrast, and does not exhibit satisfactory results.

In the invention when using an automatic developing apparatus, the total processing time (Dry to Dry) is preferably 20–60 seconds. The total processing time is the time taken from the entry of the leading edge of a film in the apparatus to the delivery of the tail end of the film out of the drying zone of the apparatus. The total processing time referred to herein is the total time necessary to process black-and-white silver halide photographic light-sensitive material, and concretely, the time necessary to carry out the steps, developing, fixing, bleaching, washing, stabilizing and drying, which is Dry to Dry time. Dry to Dry time less than 20 seconds results in desensitizing and low contrast, and does not exhibit satisfactory results. The Dry to Dry time is more preferably 30 to 60 seconds.

The developer used in the invention preferably contains a compound represented by the following Formula [P]:

Formula [P]

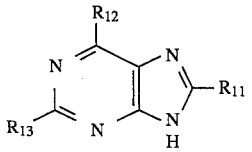

In Formula [P] $R_{11}$, $R_{12}$, and $R_{13}$ independently represent a hydrogen atom, —$SM_1$, a hydroxy group, a lower alkoxy group, —$COOM_2$, an amino group, —$SO_3M_3$ or a lower alkyl group, provided that at least one of $R_{11}$, $R_{12}$, and $R_{13}$ represents —$SM_1$, wherein $M_1$, $M_2$ and $M_3$ independently represent a hydrogen atom, an alkali metal atom or an ammonium group and may be the same or different.

In Formula [P] the lower alkyl or alkoxy group represented by $R_{11}$, $R_{12}$, and $R_{13}$ is a group having 1 to 5 carbon atoms which may have a substituent, and preferably a group having 1 to 3 carbon atoms. The amino group represented by $R_{11}$, $R_{12}$, and $R_{13}$ may have a substituent which is preferably a lower alkyl group.

In Formula [P] the ammonium group may be a substituted or unsubstituted ammonium group, and preferably an unsubstituted ammonium group.

The Exemplified compounds represented by Formula [P] will be shown below, but the invention is not limited thereto.

P-1

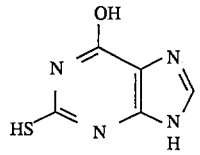

P-2

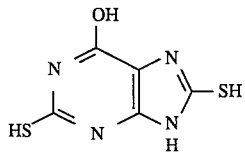

P-3

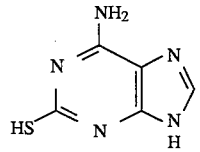

P-4

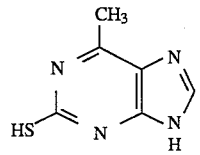

P-5

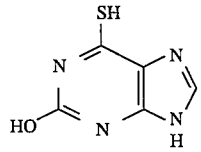

P-6

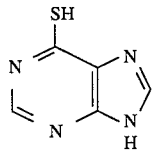

P-7

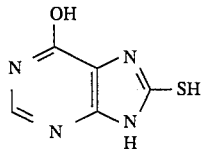

P-8

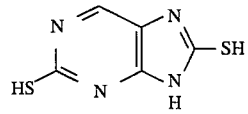

EXAMPLES

The invention will be detailed in the following examples.

Example 1

Preparation of Silver Halide Emulsion A

A silver bromoiodochloride emulsion containing 90 mol % of silver chloride, 0.2 mol % of silver iodide and silver bromide was prepared in a double-jet precipitation method. In the process $K_3RhBr_6$ was added in an amount of $8.1\times10^{-8}$ mol/mol of silver. The resulting emulsion was proved to be an emulsion comprising cubic monodisperse grains having an average particle diameter of 0.20 μm (with a variation coefficient of The emulsion was desalted with denatured gelatin disclosed in Japanese Patent O.P.I. Publication No. 2-280139 (one in which an amino group in gelatin is substituted with a phenylcarbamyl group, for example, Exemplified compound G-8 in Japanese Patent O.P.I. Publication No. 2-280139). The resulting EAg after the desalting was 190 mv at 50° C. The resulting emulsion was adjusted to be pH 5.58 and EAg 123 mv, and the temperature thereof was elevated to 60° C. To the emulsion was added $2.2\times10^{-5}$ mol/mol of silver of chloroauric acid and the mixture was stirred for 2 minutes. To the mixture emulsion was added $2.9\times10^{-6}$ mol/mol of silver of $S_8$ and the mixture was chemically ripened for 78 minutes. After the ripening, 4-hydroxy-6-methyl-1,3,3a,7-tetrazaindene of $7.5\times10^{-3}$ mol per mol of silver, $3.5\times10^{-4}$ mol per mol of silver of 1-phenyl-5-mercaptotetrazole and 28.4 g per mol of silver of gelatin were added to the emulsion to obtain an emulsion solution.

Preparation of Silver Halide Photographic Light-Sensitive Material

A 100 μm thick polyethylene terephthalate film subjected to anti-static treatment disclosed in Example 1 of Japanese Patent O.P.I. Publication No. 3-92175 was coated on the subbing layer on one side with silver halide emulsion of the following prescription 1-1 to give a silver content of 3.3 g/m² and a gelatin content of 1.6 g/m². As a protective layer the composition of the following prescription 1-2 was coated on the emulsion layer to give a gelatin content of 0.8 g/m². The backing layer composition of the following prescription 1-3 was coated on the subbing layer on the other side to give a gelatin content of 1.7 g/m2and the backing protective layer composition of the following prescription 1-4 was coated on the backing layer to give a gelatin content of 1 g/m². Thus, sample Nos. 1-11 shown in Table 1 were prepared.

Prescription 1-1
(silver halide emulsion layer composition)

| | |
|---|---|
| Gelating | 1.6 g/m² |
| Silver halide emulsion A | 3.3 g/m² |
| Sensitizing Dye | 6.0 mg |

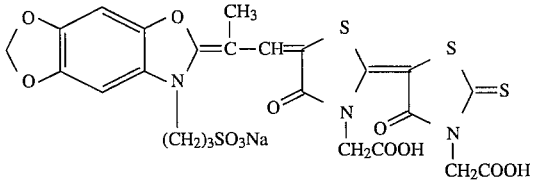

| | |
|---|---|
| Hydrazine derivative Exemplified compound (H-3) | $2\times10^{-4}$ mol/molAg |

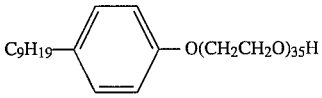

| | |
|---|---|
| | 100 mg/m² |
| Nuclear promoting agent Exemplified compound (Z-2) | $2\times10^{-3}$ mol/molAg |
| Ther latex of the invention (a to h) or Comparative latex (a', b', c') | 2.0 g/m² |
| Hardener H-1 | 60 mg/m² |

-continued

Prescription 1-1
(silver halide emulsion layer composition)

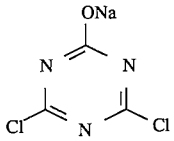

| | |
|---|---|
| S-1 (sodium isoamyl-n-decylsulfosuccinate) | 0.64 mg/m² |
| 2-mercapto-6-hydroxypurine | 1.7 mg/m² |

Preparation of Comparative Latexes, a', b' and c'

The Comparative latexes, a', b' and c' were prepared in the same manner as in above Preparation Examples 1, 2 and 7, respectively, except that sodium dedecylbenzene sulfonate as a low molecular hydrophilic surfactant was used instead of A-4.

Prescription 1-2
(Emulsion Protective layer composition)

| | |
|---|---|
| Gelatin | 0.8 g/m² |
| S-1 | 12 mg/m² |
| Matting agent: | 22 mg/m² |
| monodisperse silica having an average particle size of 3.5 μm | 40 mg/m² |
| 1,3-vinylsulfonyl-2-propanol | |
| Surfactant | 0.6 mg/m² |

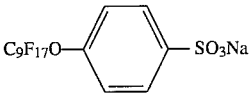

Presecription 1-3 (Backing layer composition)

| | |
|---|---|
| Gelatin | 1.7 g/m² |
| Saponin | 133 mg/m² |
| S-1 | 6 mg/m² |
| Colloid silica (an averge particle size of 0.15 μm) | 100 mg/m² |
| Dye: | |
| (a) | 30 mg/m² |

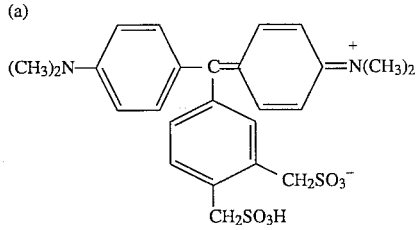

| | |
|---|---|
| (b) | 75 mg/m² |

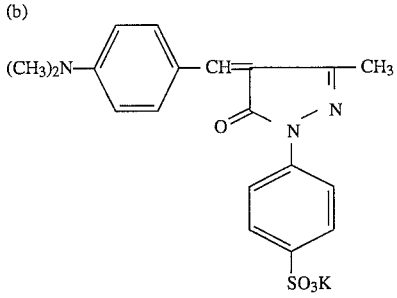

-continued (c) 30 mg/m²

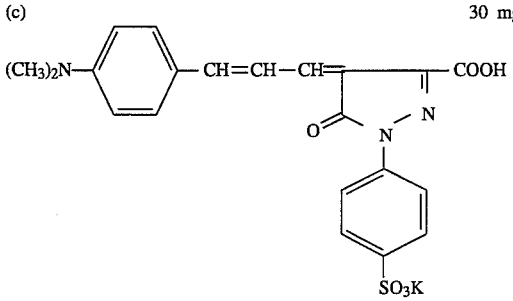

100 mg/m²

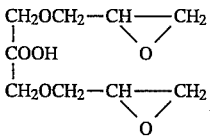

Prescription 1-4
(Backing protective layer composition)

| | |
|---|---|
| Gelatin | 1 g/m² |
| Matting agent: monodisperse polymethylmethacrylate having an average particle size of 5.0 μm | 50 mg/m² |
| Sodium di-(2-ethylhexyl)sulfosuccinate | 10 mg/m² |

The above obtained samples were in close contact with a step wedge and exposed using a 633 nm light through an interference filter as a representative of He-Ne laser light. The exposed materials were processed with the following developer and fixer under the following conditions, using an automatic developing machine (GR-27 produced by Konica Corporation).

The fresh developer solution and fatigue developer solution were used for evaluation. The fresh solution refers to a newly prepared developer solution and the fatigue solution refers to a developer solution after 2000 sheets of 20×25 inches films were processed while the developer replenisher was replenished in an amount of 150 ml per m² of the film processed.

(Developer Prescription)

| | |
|---|---|
| Sodium sulfite | 55 g/liter |
| Sodium carbonate | 40 g/liter |
| Hydroquinone | 24 g/liter |
| 4-methyl-4-hydroxymehtyl-1-phenyl-3-pyrazolidone (Dimeson S) | 0.9 g/liter |
| Potassium bormide | 5 g/liter |
| 5-methyl-benzotriazole | 0.13 g/liter |
| Boric acid | 2.2 g/liter |
| Diethylene glycol | 40 g/liter |
| Exemplified compound P-1 | 60 mg/liter |

Add water to make 1 liter and adjust pH with sodium hydroxide to be 10.5.

(Fixer Prescription)

| | |
|---|---|
| Composition A | |
| Ammonium thiosulfate (72.5% W/V solution | 240 ml |
| Sodium sulfite | 17 g |
| Sodium acetate trihydrate | 6.5 g |
| Boric acid | 6.0 g |
| Citric acid.bihydrate | 2.0 g |
| Composition B | |
| Pure water (deionized water) | 17 ml |
| Surfuric acid (aq. 50% W/V solution) | 4.7 g |
| Aluminum sulfate (an aqueous 8.1% W/V solution converted into an $Al_2O_3$ content) | 26.5 g |

The above compositions A and B were dissolved in 500 ml and water was added to make 1 liter. The resulting solution was adjusted with acetic acid to be pH 4.8.

(Processing condition)

| (Processing step) | (Temperature) | (Time) |
|---|---|---|
| Developing | 35° C. | 30 seconds |
| Fixing | 33° C. | 20 seconds |
| Washing | room temp. | 20 seconds |
| Drying | 40° C. | 40 seconds |

The processed samples were measured using PDA-65 (Konica Digital Densitometer). The sensitivity in Table was indicated by sensitivity relative to the sensitivity at density 3.0 of Sample No.1 regarded as 100. The gamma value was represented by tangent of a slope of a line combining density 0.1 with density 3.0 in the photographic characteristic curve. When the gamma value is less than 6, it can not be put into practical use. When the gamma value is 6 to less than 10, it is not a satisfactory contrast. The material having a gamma value of not less than 10 gives an ultra high contrast and can be put into practical use.

The black spots in unexposed portions were observed using a 40 power magnifier. No black spots were defined to be Rank 5, and Ranks 4, 3, 2 and 1 were defined with increasing amounts of black spots. The samples ranking 1 or 2 cannot be put into practical use.

The results are shown in Table 1.

TABLE 1

| Sample No. | Kinds of Latexes | Sensitivity: Fresh solutions | Sensitivity: Solutions after processing | Fog: Fresh solutions | Fog: Solutions after processing | Gamma value: Fresh solutions | Gamma value: Solutions after processing | Black spots: Fresh solutions | Black spots: Solutions after processing |
|---|---|---|---|---|---|---|---|---|---|
| 1-1 (Comp.) | a' | 100 | 152 | 0.07 | 0.09 | 12.4 | 9.8 | 4 | 3 |
| 1-2 (Comp.) | b' | 105 | 181 | 0.08 | 0.12 | 13.7 | 10.2 | 4 | 2 |
| 1-3 (Comp.) | c' | 129 | 81 | 0.06 | 0.06 | 12.1 | 11.8 | 2 | 2 |
| 1-4 (Inv.) | a | 145 | 139 | 0.03 | 0.03 | 15.9 | 15.9 | 5 | 5 |
| 1-5 (Inv.) | b | 131 | 135 | 0.02 | 0.03 | 16.1 | 16.0 | 5 | 5 |
| 1-6 (Inv.) | c | 129 | 125 | 0.03 | 0.03 | 17.3 | 17.2 | 5 | 5 |
| 1-7 (Inv.) | d | 135 | 131 | 0.03 | 0.03 | 15.5 | 15.6 | 5 | 5 |
| 1-8 (Inv.) | e | 132 | 135 | 0.02 | 0.02 | 16.2 | 16.1 | 5 | 5 |
| 1-9 (Inv.) | f | 130 | 128 | 0.03 | 0.03 | 16.6 | 16.7 | 5 | 5 |
| 1-10 (Inv.) | g | 136 | 140 | 0.03 | 0.03 | 15.9 | 16.0 | 5 | 5 |
| 1-11 (Inv.) | h | 141 | 144 | 0.03 | 0.03 | 16.3 | 16.1 | 5 | 5 |

Comp.: Comparative
Inv.: Invention

As is apparent from above Table, Invention samples 1-4 through 1-11 show high sensitivity, a high gamma, less fog and no black spots. On the contrary, Comparative samples 1-1 and 1-2, which contain the latex prepared using a low molecular surfactant, show inferior photographic properties, and Comparative sample 1-3, which contains the conventional latex using a high molecular protective colloid, shows inferior photographic properties as well as the occurrence of black spots.

EXAMPLE 2

Preparation of Silver Halide Emulsion A'

A silver bromochloride emulsion (having a silver chloride content of 65 mol % per mol of silver) was prepared in a double-jet precipitation method. In the process $K_2IrCl_6$ in an amount of $8\times10^{-7}$ mol/mol of silver and $Na_2RhCl_6$ in an amount of $1\times10^{-7}$ mol/mol of silver were added. The resulting emulsion was proved to be an emulsion comprising cubic monodisperse grains having an average particle diameter of 0.20 μm (with a variation coefficient of 10%). To the emulsion was added a sensitizing dye and was desalted by the conventional method. Thereafter, to the emulsion was added the following mixture of A, B and C (A:B:C=1:1:1, mol ratio) in an amount of 10 mg per mol of silver and then the emulsion were subjected to gold-sulfur sensitization to give Emulsion A'.

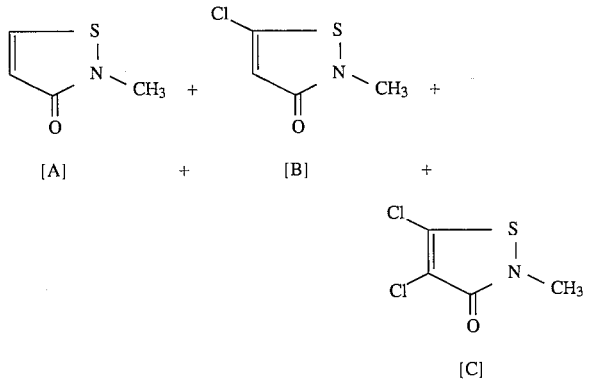

Preparation of Silver Halide Photographic Light-Sensitive Material Sample

On the one side of a 100 pin thick polyethlene terephthalate support on which a 0.1 μm thick subbing layer was provided in the same manner as in Example 1 of U.S. Pat. No. 4,571,379 was coated the silver halide emulsion layer composition of the following Prescription 2-1 to give coating amounts of 3.2 g/m$^2$ of silver and 1.5 g/m$^2$ of gelatin. The emulsion protective layer Composition of the following Prescription 2-2 was further coated on the emulsion layer to give a gelatin content of 0.9 g/m$^2$. The backing layer of the following prescription 2-3was coated on the subbing layer on the other side to give a gelatin content of 2.4 g/m$^2$ and the backing protective layer of the following prescription 2-4 was coated on the backing layer to give a gelatin content of 1 g/m$^2$. Thus, sample Nos. 241 to 2-7 shown in Table 2 were prepared.

| Prescription 2-1 (Silver halide emulsion layer composition) | |
|---|---|
| Gelatin | 1.5 g/m$^2$ |
| silver halide emulsion A' (in terms of silver) | 3.2 g/m$^2$ |
| Sensitizing Dye: SD-1 | 1.0 mg/m$^2$ |
| Stabilizer: 4-methyl-6-hydroxy-1.3,3a,7-tetrazaindene | 30 mg/m$^2$ |
| Anti-foggant: | |
| adenine | 10 mg/m$^2$ |
| 5-sodiumsulfo-2-mercaptobenzimidazole | 5 mg/m$^2$ |
| Surfactant: | |
| Saponin | 0.1 g/m$^2$ |
| S-1 | 8.0 mg/m$^2$ |
| Hydrazine derivative: | |
| H-1 | 25 mg/m$^2$ |
| H-2 | 2 mg/m$^2$ |
| Nucleation accelerating agent Z-1 | 40 mg/m$^2$ |
| Later (a) through (e), (i), (iii) | 1.5 mg/m$^2$ |
| Polyethylene glycol (molecular weight 4000) | 0.1 g/m$^2$ |
| Sensitizing Dye: SD-1 | |

-continued

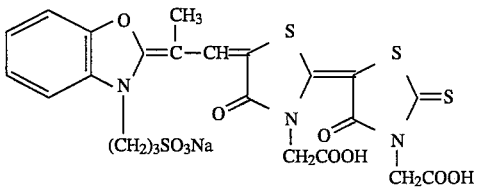

Prescription 2-2
(Emulsion protective layer composition)

| | |
|---|---|
| Gelatin | 0.9 g/m$^2$ |
| Surfactant S-2 | 10 mg/m$^2$ |
| $CH_2COOCH_2(C_2H_5)C_4H_9$ | |
| \| | |
| $CHCOOCH_2CH(C_2H_5)C_4H_9$ | |
| \| | |
| $SO_3Na$ | |
| Surfactant S-3 | 5 mg/m$^2$ |
| $C_9F_{17}O$— 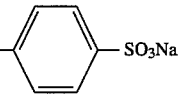 —$SO_3Na$ | |
| Matting agent: monodisperse silica having an average particle size of 3.5 μm | 10 mg/m$^2$ |
| Hardener 1,3-vinylsulfonyl-2-propanol | 40 mg/m$^2$ |

Prescription 2-3 (Backing layer composition)

| | |
|---|---|
| (a) | 70 mg/m$^2$ |
| (b) | 50 mg/m$^2$ |
| (c) | 20 mg/m$^2$ |
| Gelatin | 2.4 g/m$^2$ |
| Surfactant saponin | 0.1 g/m$^2$ |
| S-1 | 6 mg/m$^2$ |
| $CH_2COO(CH_2)_9CH_3$ | |
| \| $CH_3$ | |
| $CH_2COO(CH_2)_2CH$ | |
| \| $CH_3$ | |
| $SO_3Na$ | |
| Colloid silica (an average particle size of 0.07 μm) | 100 mg/m$^2$ |

Prescription 2-4
(Backing protective layer composition)

| | |
|---|---|
| Gelatin | 1 g/m$^2$ |
| Matting agent: monodisperse polymethylmethacrylate having an average particle size of 3.5 μm | 40 mg/m$^2$ |
| Surfactant S-2 | 10 mg/m$^2$ |
| Hardener glyoxal | 35 mg/m$^2$ |

Evaluation of Photographic Property

The above obtained samples were in close contact with a step wedge and exposed for $2\times10^{-6}$ seconds through He-Ne laser light. The exposed materials were processed under the following conditions using an automatic developing machine for rapid processing (GR-26SR produced by Konica Corporation) containing the following developer and fixer.

The resulting samples were measured for sensitometry using PDA-65 (produced by Konica Corporation). The sensitivity was indicated by a relative sensitivity to sensitivity at density 2.5 of Sample No.1 regarded as 100. The gamma value was indicated by a tangent between the densities 0.1 and 2.5. The evaluation of black spots was conducted in the same manner as in Example 1.

(Developer Composition 1)

| | |
|---|---|
| Potassium sulfite | 50.0 g |
| Hydroquinone | 20.0 g |
| 4-methyl-4-hydroxymethyl-1-phenyl-3-pyrazolidone | 1.0 g |
| Disodium ethylenediamine tetraacetate | 2.0 g |
| Potassium carbonate | 12.0 g |
| Potassium bromide | 5.0 g |
| 5-methylbenzotriazole | 0.3 g |
| Diethylene glycol | 25.0 g |
| Compound (d) | 0.1 g |
| Add water to make | 1 liter |

Adjust to pH 10.4 with potassium hydroxide.

(Fixer Prescription)

Composition A

| | |
|---|---|
| Ammonium thiosulfate (72.5% W/V solution) | 200 ml |
| Sodium sulfite | 17 g |
| Sodium acetate trihydrate | 6.5 g |
| Boric acid | 6.0 g |
| Citric acid.bihydrate | 2.0 g |
| Pure water (deionized water) | 17 ml |
| Surfuric acid (aq. 50% W/V solution) | 2.0 g |
| Aluminum sulfate (an aqueous 8.1% W/V solution converted into an $Al_2O_3$ content) | 8.5 g |
| Add water to make | 1 liter |

Adjust to pH 4.8 with acetic acid.

(d)

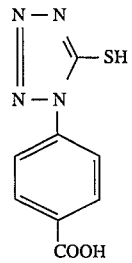

Processing Condition

Each of the processing time includes a cross-over time.

| Process | Temperature | Time |
|---|---|---|
| Development | 38° C. | 12 seconds |
| Fixing | 35° C. | 10 seconds |
| Washing | 30° C. | 10 seconds |
| Drying | 50° C. | 13 seconds |
| Total time | | 45 seconds |

TABLE 2

| Sample No. | Kinds of Latexes | Sensitivity: Fresh solutions | Sensitivity: Solutions after processing | Fog: Fresh solutions | Fog: Solutions after processing | Gamma value: Fresh solutions | Gamma value: Solutions after processing | Black spots: Fresh solutions | Black spots: Solutions after processing |
|---|---|---|---|---|---|---|---|---|---|
| 2-1 (Comp.) | a' | 100 | 141 | 0.08 | 0.10 | 6.3 | 5.8 | 3 | 2 |
| 2-2 (Comp.) | c' | 88 | 103 | 0.05 | 0.07 | 8.1 | 7.0 | 3 | 2 |
| 2-3 (Inv.) | a | 151 | 150 | 0.04 | 0.04 | 12.1 | 13.0 | 4 | 4 |
| 2-4 (Inv.) | b | 143 | 145 | 0.03 | 0.03 | 12.4 | 13.0 | 4 | 5 |
| 2-5 (Inv.) | c | 150 | 148 | 0.03 | 0.03 | 13.1 | 13.4 | 5 | 5 |
| 2-6 (Inv.) | d | 149 | 147 | 0.03 | 0.03 | 12.8 | 13.0 | 5 | 5 |
| 2-7 (Inv.) | e | 139 | 142 | 0.03 | 0.03 | 12.6 | 12.9 | 4 | 5 |

Comp.: Comparative
Inv.: Invention

As is apparent from Table 2, Invention samples 2-3 through 2-7 show high sensitivity, a high gamma, less fog and less black spots as compared with Comparative samples 2-1 and 2-2.

EXAMPLE 3

Preparation of Silver Halide Photographic Light-Sensitive Material

A 100 μm thick polyethylene terephthalate film subjected to anti-static treatment disclosed in Example 1 of Japanese Patent O.P.I. Publication No. 3-92175 was coated on the subbing layer on one side with the silver halide emulsion of the following prescription B-1 to give a silver content of 3.3 g/m$^2$ and a gelatin content of 2.6 g/m$^2$.

As a protective layer the coating solution of the following prescription 3-2 was coated on the emulsion layer to give a gelatin content of 1.0 g/m$^2$. The backing layer of the following prescription 3-3 was coated on the subbing layer on the other side to give a gelatin content of 2.7 g/m$^2$ and the backing protective layer of the following prescription 3-4 was coated on the backing layer to give a gelatin content of 1 g/m$^2$. Thus, sample Nos. 3-1 to 3-11 shown in Table 3 were prepared.

Prescription 3-1
(silver halide emulsion layer composition)

| | |
|---|---|
| Gelatin | 2.6 g/m$^2$ |
| Silver halide emulsion A | 3.3 g/m$^2$ |
| Sensitizing Dye | 6.0 mg/m$^2$ |

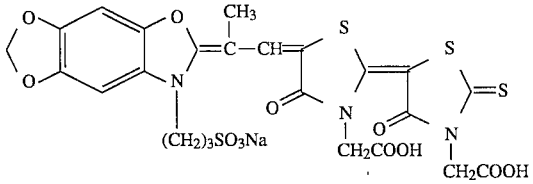

| | |
|---|---|
| Hydrazine derivative Exemplified compound (H-8) | 2 × 10$^{-4}$ mol/molAg |
| Compound | 100 mg/m$^2$ |

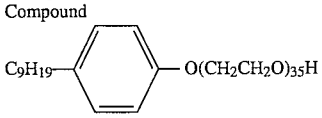

| | |
|---|---|
| Nuclear promoting agent Exemplified compound (Z-2) | 1 × 10$^{-3}$ mol/molAg |

-continued

Prescription 3-1
(silver halide emulsion layer composition)

| | |
|---|---|
| The latex of the invention (i to p) or Comparative latex (d', e', f') | 2.0 g/m$^2$ |
| Hardener | 60 mg/m$^2$ |

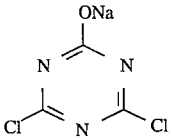

| | |
|---|---|
| S-1 (sodium isoamyl-n-decylsulfosuccinate) | 0.64 mg/m$^2$ |
| 2-mercapto-6-hydroxypurine | 1.7 g/m$^2$ |

Preparation of Comparative Latexes, d', e' and f'

1. The Comparative latex, d' was prepared in the same manner as in above Synthetic Example 2-1, except that 7.0 g of sodium dedecylbenzene sulfonate was used instead of dextran sulfate sodium salt.

2. The Comparative latex, e' was prepared in the same manner as in above Synthetic Example 2-2, except that sodium dedecylbenzene sulfonate was used instead of dextran sulfate sodium salt.

3. The polymerization was carried out according to a method described in Japanese Patent Publication No. 53-47371. Thus, Comparative latex, f' was obtained which has polyvinyl alcohol as a protective colloid.

Prescription 3-2
(Emulsion protective layer composition)

| | |
|---|---|
| Gelatin | 1 g/m$^2$ |
| S-1 | 12 mg/m$^2$ |
| Matting agent: monodisperse silica having an average particle size of 3.5 μm | 22 mg/m$^2$ |
| 1,3-vinylsulfonyl-2-propanol | 40 mg/m$^2$ |
| Surfactant | 0.6 mg/m$^2$ |

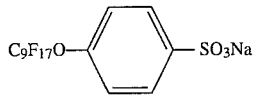

Prescription 3-3

-continued

| (Backing layer composition) | |
|---|---|
| Gelatin | 2.7 g/m$^2$ |
| Saponin | 133 mg/m$^2$ |
| S-1 | 6 mg/m$^2$ |
| Colloid silica (an average particle size of 0.15 μm) | 100 mg/m$^2$ |
| Dye: | |
| (a) | 30 mg/m$^2$ |
| (b) | 75 mg/m$^2$ |
| (c) | 30 mg/m$^2$ |
| Compound | 100 mg/m$^2$ |

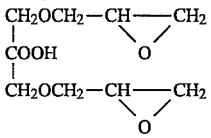

| Prescription 3-4 (Backing protective layer composition) | |
|---|---|
| Gelatin | 1 g/m$^2$ |
| Matting agent: monodisperse polymethylmethacrylate having an average particle size of 5.0 μm | 50 mg/m$^2$ |
| Sodium di-(2-ethylhexyl)sulfosuccinate | 10 mg/m$^2$ |

The above obtained samples were processed and evaluated in the same manner as in Example 1.

The results are shown in Table 3.

TABLE 3

| Sample No. | Kinds of latexes | Sensitivity | Fog | Gamma value | black spots | Note |
|---|---|---|---|---|---|---|
| 3-1 | d' | 100 | 0.08 | 11.2 | 4 | Comp. |
| 3-2 | e' | 97 | 0.07 | 10.7 | 4 | Comp. |
| 3-3 | f' | 126 | 0.04 | 13.5 | 2 | Comp. |
| 3-4 | i | 135 | 0.03 | 14.6 | 5 | Inv. |
| 3-5 | j | 136 | 0.02 | 15.0 | 5 | Inv. |
| 3-6 | k | 135 | 0.03 | 14.4 | 5 | Inv. |
| 3-7 | l | 136 | 0.03 | 14.6 | 5 | Inv. |
| 3-8 | m | 136 | 0.02 | 14.0 | 5 | Inv. |
| 3-9 | n | 136 | 0.03 | 14.8 | 5 | Inv. |
| 3-10 | o | 133 | 0.03 | 14.4 | 5 | Inv. |
| 3-11 | p | 132 | 0.03 | 15.1 | 5 | Inv. |

Comp.: Comparative
Inv.: Invention

As is apparent from above Table, Invention samples 3-4 through 3-11 show high sensitivity, a high gamma, less fog and no black spots. On the contrary, Comparative samples 3-1 and 3-2, which contain the latex prepared using a low molecular surfactant, show inferior photographic properties, and Comparative sample 3-3, which contains the conventional latex using a high molecular protective colloid, shows inferior photographic properties as well as the occurrence of black spots.

EXAMPLE 4

Preparation of Silver Halide Photographic Light-Sensitive Material Sample

On the one side of a 100 μm thick polyethlene terephthalate support on which a 0.1 μm thick subbing layer was provided in the same manner as in Example 1 of U.S. Pat. No. 4,571,379 was coated the silver halide emulsion layer composition of the following Prescription 4-1 to give coating amounts of 3.2 g/m$^2$ of silver and 1.5 g/m$^2$ of gelatin. The emulsion protective layer composition of the following Prescription 4-2 was further coated on the emulsion layer to give a gelatin content of 1.0 g/m$^2$. The backing layer of the following prescription 4-3 was coated on the subbing layer on the other side to give a gelatin content of 2.4 g/m$^2$ and the backing protective layer of the following prescription 4-4 was coated on the backing later to give a gelatin content of 1 g/m$^2$. Thus, sample Nos. 4-1 to 4-7 shown in Table 4 were prepared.

| Prescription 4-1 (Silver halide emulsion layer composition) | |
|---|---|
| Gelatin | 1.5 g/m$^2$ |
| Silver halide emulsion A' (in terms of silver) | 3.2 g/m$^2$ |
| Sensitizing Dye SD-1 | 1.0 mg/m$^2$ |
| Stabilizer: 4-methyl-6-hydroxy-1.3,3a,7-tetrazaindene | 30 mg/m$^2$ |
| Anti-figgant: | |
| adenine | 10 mg/m$^2$ |
| 5-sodiumsulfo-2-mercaptobenzimidazole | 5 mg/m$^2$ |
| Surfactant: | |
| Saponin | 1.0 g/m$^2$ |
| S-1 | 8.0 mg/m$^2$ |
| Hydrazine derivative: | |
| (H-1) | 25 mg/m$^2$ |
| (H-2) | 2 mg/m$^2$ |
| Nucleation accelerating agent (Z-10) | 40 mg/m$^2$ |
| Latexes i through m or d', e', f' | 1.5 mg/m$^2$ |
| Polyethylene glycol (molecular weight 4000) | 0.1 g/m$^2$ |
| Prescription 4-2 (Emulsion protective layer composition) | |
| Gelatin | 1.0 g/m$^2$ |
| Surfactant S-2 | 10 mg/m$^2$ |
| Surfactant S-3 | 5 mg/m$^2$ |
| Matting agent: monodisperse silica having an average particle size of 3.5 μm | 10 mg/m$^2$ |
| Hardener 1,3-vinylsulfonyl-2-propanol | 40 mg/m$^2$ |
| Prescription 4-3 (Backing layer composition) | |
| Dye: | |
| (a) | 70 mg/m$^2$ |
| (b) | 50 mg/m$^2$ |
| (c) | 20 mg/m$^2$ |
| Gelatin | 2.4 g/m$^2$ |
| Surfactant saponin | 0.1 g/m$^2$ |
| S-1 | 6 mg/m$^2$ |
| Colloid silica (an average particle size of 0.07 μm) | 100 mg/m$^2$ |
| Prescription 4-4 (Backing protective layer composition) | |
| Gelatin | 1 g/m$^2$ |
| Matting agent: monodisperse polymethylmethacrylate having an average particle size of 3.5 μm | 40 mg/m$^2$ |
| Surfactant S-2 | 10 mg/m$^2$ |
| Hardener glyoxal | 35 mg/m$^2$ |

Evaluation of Photographic Property

The above obtained samples were processed in the same manner as in Example 2.

The results are shown in Table 4.

TABLE 4

| Sample No. | Kinds of latexes | Sensitivity | Fog | Gamma value | black spots | Note |
|---|---|---|---|---|---|---|
| 4-1 | d' | 100 | 0.08 | 5.5 | 4 | Comp. |
| 4-2 | f' | 135 | 0.05 | 6.7 | 2 | Comp. |
| 4-3 | i | 142 | 0.04 | 10.5 | 4 | Inv. |
| 4-4 | j | 143 | 0.03 | 10.5 | 4 | Inv. |
| 4-5 | k | 143 | 0.03 | 10.5 | 5 | Inv. |
| 4-6 | l | 143 | 0.04 | 10.0 | 5 | Inv. |
| 4-7 | m | 142 | 0.03 | 10.5 | 4 | Inv. |

Comp.: Comparative
Inv.: Invention

As is apparent from Table 2, Invention samples 4-3 through 4-7 show high sensitivity, a high gamma, less fog and less black spots as compared with Comparative samples 4-1 and 4-2.

What is claimed is:

1. A silver halide photographic light-sensitive material comprising a support having provided thereon, a photographic component layer comprising a silver halide emulsion layer and a hydrophilic colloid layer other than said emulsion layer, said photographic component layer containing a hydrazine derivative, a nucleation accelerating agent, and a polymer latex containing a hydrophobic polymer and, as a protective colloid, a hydrophilic polymer other than gelatin, said hydrophilic polymer having an average number molecular weight of 1,000 to 1,000,000, and a solubility of not less than 0.1 g in 100 g of water at 20° C.

2. The material of claim 1, wherein the hydrophilic polymer is a polymer containing in its chemical structure both nonionic group and anionic group.

3. The material of claim 2, wherein the nonionic group is selected from the group consisting of an ether group, an ethylene oxide group and a hydroxy group.

4. The material of claim 2, wherein the anionic group is selected from the group consisting of a sulfonic acid or its salt, a carboxylic acid or its salt and a phosphoric acid group or its salt.

5. The material of claim 2, wherein the nonionic group is selected from the group consisting of an ether group, an ethylene oxide group and a hydroxy group, and the anionic group is selected from the group consisting of a sulfonic acid or its salt, a carboxylic acid or its salt and a phosphoric acid group or its salt.

6. The material of claim 1, wherein the hydrophilic polymer is a water-soluble natural polymer selected from the group consisting of lignin, starch, pullulan, cellulose, alginic acid, dextran, dextrin, guar gum, gum arabic, glycogen, laminarin, lichenin, nigellone and derivatives thereof.

7. The material of claim 6, wherein the derivatives are selected from the group consisting of lignin, starch, pullulan, cellulose, alginic acid, dextran, dextrin, guar gum, gum arabic, glycogen, laminarin, lichenin and nigellone which are sulfonated, carboxylated, phosphorylated, sulfoalkylated, carboxyalkylated or alkylphosphorylated and their salts.

8. The material of claim 1, wherein the polymer latex is contained in the silver halide emulsion layer.

9. The material of claim 8, wherein the polymer latex content of the silver halide emulsion layer is 10 to 300% by weight in terms of polymer based on the content of gelatin contained in the silver halide emulsion layer.

10. The material of claim 1, wherein the hydrazine derivative and the nucleation accelerating agent are contained in the silver halide emulsion layer.

11. The material of claim 10, wherein the hydrazine derivative content of the silver halide emulsion layer is $5\times10^{-7}$ to $5\times10^{-1}$ mol per mol of silver in the silver halide emulsion layer and the nucleation accelerating agent of the silver halide emulsion layer is $5\times10^{-7}$ to $5\times10^{-1}$ mol per mol of silver in the silver halide emulsion layer.

* * * * *